US006688070B2

(12) United States Patent
Vahey

(10) Patent No.: US 6,688,070 B2
(45) Date of Patent: Feb. 10, 2004

(54) STRUCTURAL MEMBER AND METHODS OF USE

(76) Inventor: Michael John Vahey, 19 Norwood Ct., Medford, NJ (US) 08055

( * ) Notice: Subject to any disclaimer, the term of this patent is extended or adjusted under 35 U.S.C. 154(b) by 0 days.

(21) Appl. No.: 10/348,291

(22) Filed: Jan. 21, 2003

(65) Prior Publication Data

US 2003/0106281 A1 Jun. 12, 2003

Related U.S. Application Data

(63) Continuation-in-part of application No. 09/898,182, filed on Jul. 3, 2001.

(60) Provisional application No. 60/217,906, filed on Jul. 13, 2000.

(51) Int. Cl.[7] ..... E04C 3/30

(52) U.S. Cl. ..... 52/732.1; 52/731.7

(58) Field of Search ..... 52/732.1, 737.6, 52/731.7

(56) References Cited

U.S. PATENT DOCUMENTS

| | | | | | |
|---|---|---|---|---|---|
| 854,397 | A | * | 5/1907 | Beach | 138/157 |
| 1,360,720 | A | * | 11/1920 | Brown et al. | 52/731.7 |
| 1,364,182 | A | * | 1/1921 | Conkling | 52/740.2 |
| 1,750,833 | A | * | 3/1930 | Carns | 52/720.1 |
| 2,020,062 | A | * | 11/1935 | Jackson | 52/364 |
| 2,508,032 | A | * | 5/1950 | Kennedy | 52/731.7 |
| 3,098,266 | A | * | 7/1963 | Oehmig | 52/213 |
| 4,002,000 | A | * | 1/1977 | Howard et al. | 52/729.5 |
| 4,069,638 | A | | 1/1978 | Hasselqvist | |
| 4,120,130 | A | | 10/1978 | Puschkarski | |
| 4,746,056 | A | | 5/1988 | Thomsen | |
| 5,307,601 | A | * | 5/1994 | McCracken | 52/364 |
| 5,379,567 | A | | 1/1995 | Vahey | |
| 5,426,906 | A | * | 6/1995 | McCracken | 52/650.1 |
| 5,464,302 | A | * | 11/1995 | Menchetti | 403/335 |
| 5,588,274 | A | | 12/1996 | Lange | |
| 5,660,008 | A | * | 8/1997 | Bevilacqua | 52/169.5 |
| 5,782,047 | A | | 7/1998 | De Quesada | |
| 5,809,734 | A | | 9/1998 | Turner | |
| 5,860,490 | A | | 1/1999 | Petti et al. | |
| 5,970,672 | A | | 10/1999 | Robinson | |
| 5,970,679 | A | | 10/1999 | Amore | |

* cited by examiner

*Primary Examiner*—Anita King
(74) *Attorney, Agent, or Firm*—Evelyn H. McConathy; Dilworth Paxson LLP

(57) ABSTRACT

Provided is a generally triangular shaped structural member having two equally sized planar sides with a plurality of indentations and a third side of the triangular shape formed from two equally sized curved components that bend into, and join within, the interior of the triangular shape. Also provided are restraining elements to prevent the unfolding of the formed structural member and elements providing increased stiffening to the structural member. Also provided are adapters, joining clamps, and cylinder clamp assemblies for fabricating structural assemblies using the structural members and methods of using the structural members.

33 Claims, 14 Drawing Sheets

FIG. 13
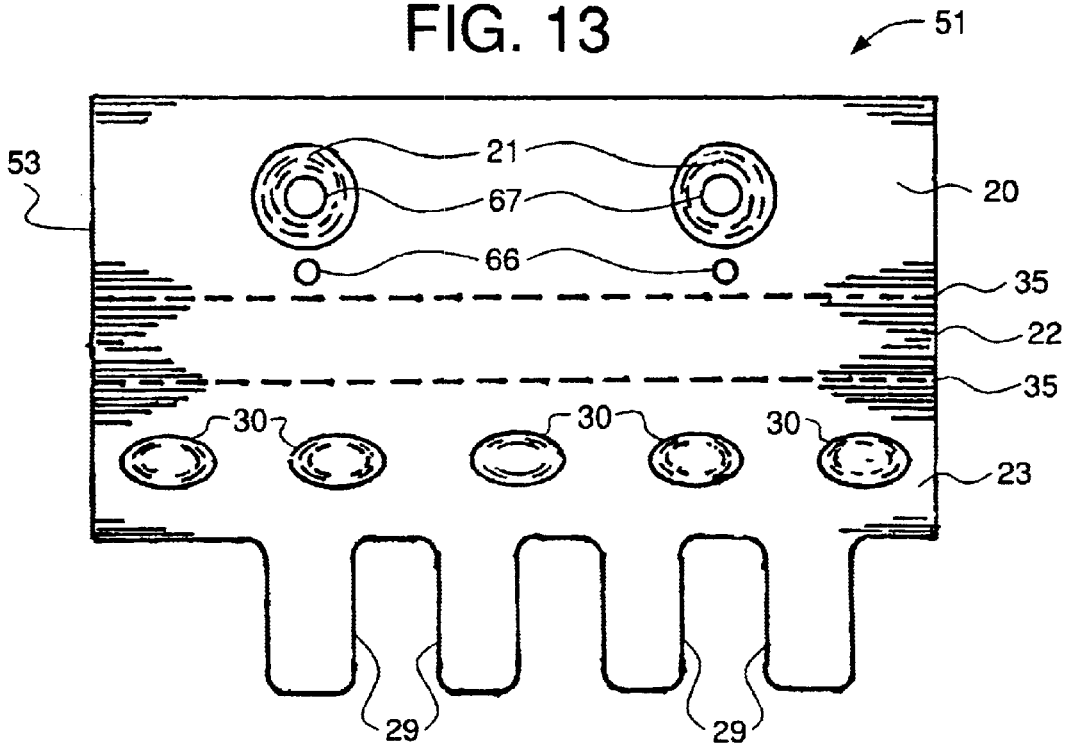
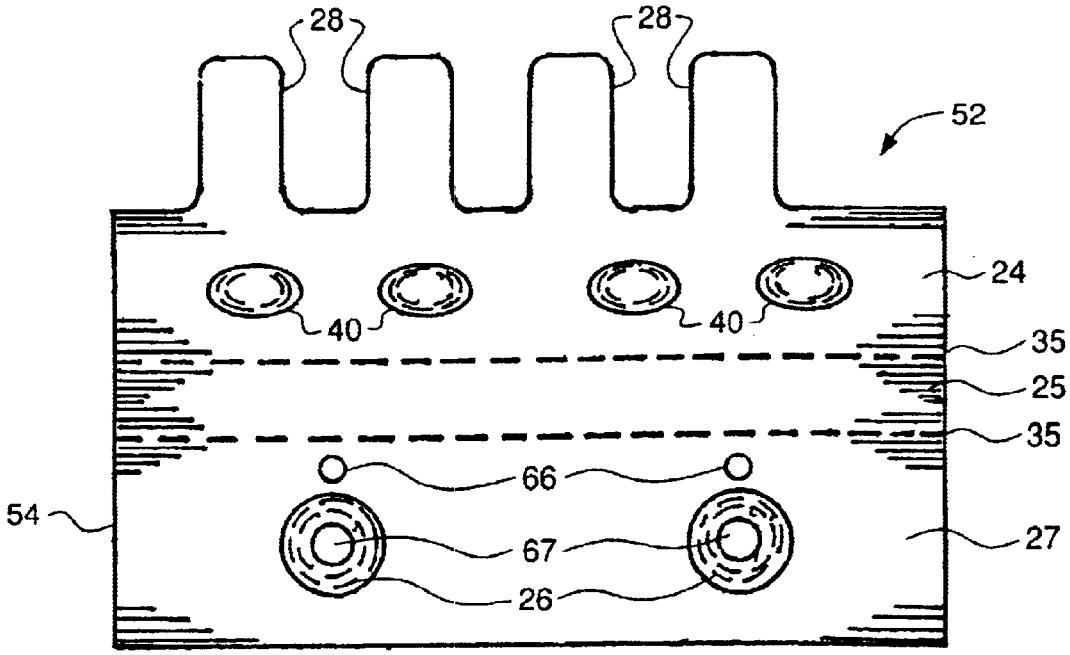
FIG. 14

STRUCTURAL MEMBER AND METHODS OF USE

REFERENCE TO RELATED APPLICATIONS

This application is a CIP of U.S. application Ser. No. 09/898,182, filed Jul. 3, 2001 which claims priority to U.S. Provisional Application No. 60/217,906, filed Jul. 13, 2000, each of which the content is herein incorporated by reference.

FIELD OF THE INVENTION

The present invention relates to new structural members offering improved structural properties and methods of using the structural members in construction and other applications.

BACKGROUND OF INVENTION

Structural members are used to provide the underlying rigid strength and support in various building, construction, manufacturing and other support and/or framing applications. Structural members also make up entire forms, such as bridges, and artistic structures, such as the Eiffel tower.

Depending on the needs of a particular application, structural members are produced in any number of sizes, materials and weights. However, most applications use the same basic structural member shapes. For instance, rectangular cut lumber, I beams, box beams, rectangular metal members, and combinations thereof comprise the majority of the structural members used today. While these structural shapes are generally adequate for most purposes, there remains an unmet need to have a structural member that is (1) rigid along its axial length and (2) allows torsional flexibility, while (3) maintaining lightweight and structural integrity.

U.S. Pat. No. 5,379,567 provides a triangular shaped structural member having torsional flexibility around its axis adapted with stabilizing rods for improved rigidity along its axial length. However, it fails to provide a structural member having the desired rigidity, flexibility, and lightweight properties to permit improved, easier methods of assembly for structural applications.

SUMMARY OF THE INVENTION

The present invention provides a structural member comprising a generally triangular shaped member having an internal region and a first, a second, and a third internal vertex, wherein a rectangular sheet having a longitudinal axis, is folded around the longitudinal axis forming a first, a second, a third and a fourth sheet, wherein the first and the second sheets are a first and a second planar side that form two sides of the triangular shape, and wherein the third and the fourth sheets comprise a first and a second curved component, each having a concave inner surface and a convex outer surface, wherein the first and the second curved components are folded into the internal region of the triangular shape so that the outer surface of the first curved component joins to the outer surface of the second curved component thereby forming the third side of the triangular shape. The structural member further comprises each planar side, having an outer surface on the outside of the member and an inner surface on the inside of the member, and having a longitudinal axis in the same direction as the longitudinal axis of the triangular shape, and a plurality of indentations spaced along the longitudinal axis of each planar side.

Additionally, the present invention provides a structural member wherein each of the plurality of the indentations is semi-ellipsoidal in shape, defined by rotation of a 36 degree, 16 minute ellipse around its long axis. In a preferred embodiment, each indentation of the structural member comprises a convex bulge on the inner surface of each planar side, wherein the convex bulge of each indentation on the first planar side contacts the inner surface of the first curved component, and the convex bulge of each indentation on the second planar side contacts the inner surface of the second curved component. In another preferred embodiment, each indentation, having an outside tangent point on the convex bulge, further comprises an embossed projection located at the outside tangent point, wherein the projection of each indentation on the first planar side contacts the inner surface of the first curved component, and the projection of each indentations on the second planar side contacts the inner surface of the second curved component.

Further provided is a structural member comprising three internal cavities within the internal region of the triangular shape, extending the length of the structural member, wherein each cavity has an apex at each internal vertex of the triangular shape.

Also provided are embodiments of the structural member comprising a restraining element located at the point where the first and second curved components join; stabilizing rods located at each apex of each internal cavity; inserts located adjacent to each stabilizing rod; and a stabilizing rod located within the restraining element.

In addition, provided is an embodiment of the structural member, the first and second curved components have a rounded edge. Also provided is a two-sided prefabricated panel having channels on both sided to be with the structural member. A structural assembly of the present invention provides fitting the panel into a structural member wherein the rounded edges of the first and second curved components fit into the first and second channels of the panel.

Also provided is an adapter for assembling two structural members together along their longitudinal axis; a joining clamp for assembling two or more structural members to each other and for assembling structural members to other braces; and a cylinder clamp assembly for assembling structural members to each other and for gauging the accuracy of the dimensions of the structural members. In addition, a clamping assembly for use with the structural members is provided. Additionally, methods of using the structural member are provided.

Additional objects, advantages and novel features of the invention will be set forth in part in the description and figures which follow, and in part will become apparent to those skilled in the art on examination of the following, or may be learned by practice of the invention.

BRIEF DESCRIPTION OF DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown.

FIG. 13 is a plan view of an embodiment of a right hand bracket of the joining clamp of FIG. 11 in a fully unfolded position.

FIG. 14 is a plan view of an embodiment of a left hand bracket of the joining clamp of FIG. 11 in a fully unfolded position.

DESCRIPTION OF THE PREFERRED EMBODIMENTS

Figure 1:
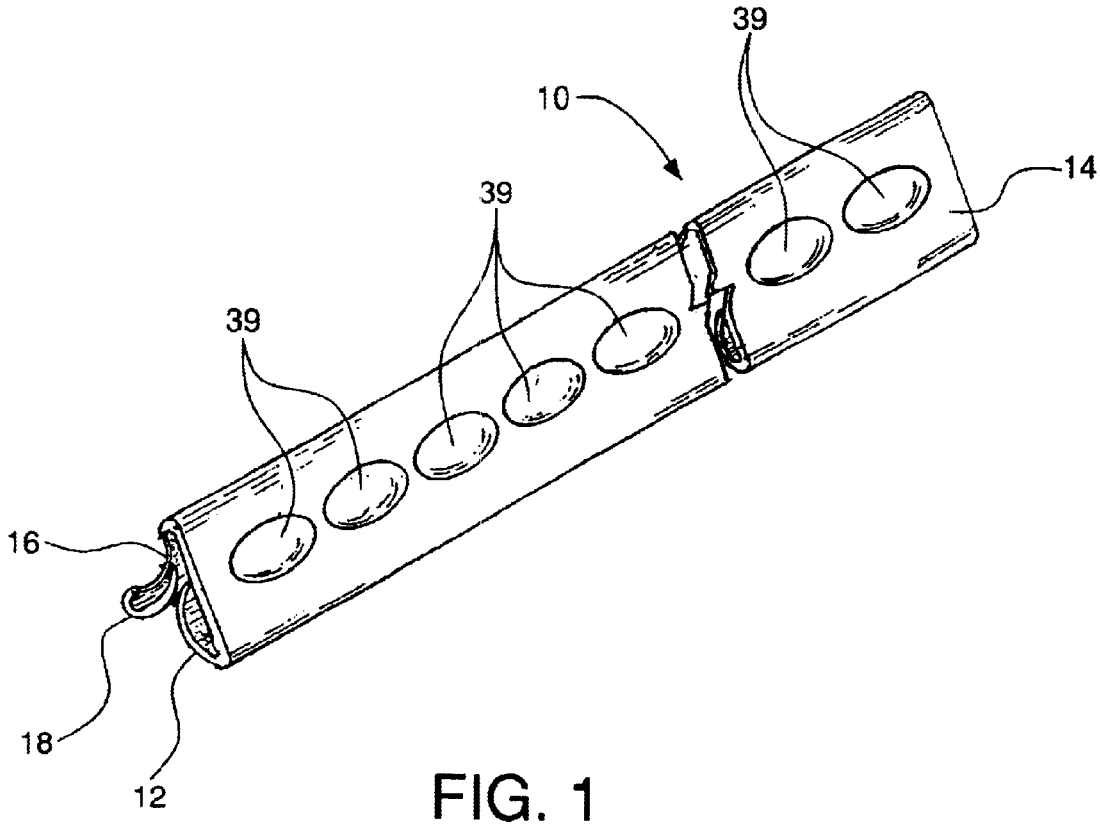
FIG. 1 is a perspective view of a preferred embodiment of a structural member of the present invention.

The description contained herein relates to structural members and methods of using the structural members in building, construction, manufacturing and other support and/or framing applications. This description, however, is intended to be illustrative only and not limiting as to the scope of the present invention. Referring now to the drawings, the details of embodiments of the invention are graphically and schematically illustrated. Like elements in the drawings are represented by like numbers.

FIG. 1 shows a preferred embodiment of structural member 10. Structural member 10 is generally triangular in shape; that is, its cross section generally forms a triangle. Structural member 10 having a longitudinal axis extending the length of structural member 10 may be produced in any range of lengths depending on how structural member 10 is used. As will be discussed in greater detail below, in a preferred embodiment, a single rectangular sheet is formed without cutting into four smaller sheets, which together create triangular shaped structural member 10. As shown in FIG. 1, a first and second sheet form a first and second side, 14 and 16, respectively, which are generally planar. Planar sides 14 and 16 are equal in size and form two of the sides of the triangular shape. As is more clearly shown in FIG. 2, the third and fourth sheets are bent without creasing to form curved components 12 and 18, which are equal in size, and which together form the third side of the triangular shape.

Each planar side 14 and 16 has an outer surface on the outside of structural member 10 and an inner surface on the inside of structural member 10. A series of indentations 39, evenly spaced along the longitudinal length of planar sides 14 and 16, create concave indentations on the outer surface of sides 14 and 16, and matched convex bulges on the inner surface of sides 14 and 16. In a preferred embodiment, indentations 39 are semi-ellipsoidal in shape, such that indentations 39 form an ellipse where they meet the outer surface of sides 14 and 16. For example, in a preferred embodiment each indentation 39 is defined by rotation of a 36 degree, 16 minutes ellipse around its long axis. However, indentations of other shapes may be used in alternative embodiments. The size of indentations 39 depends on the structural member 10 and the particular application. Thus, indentations 39 may vary in size for each structural member 10. Indentations 39 may also vary in size within structural member 10. However, in a preferred embodiment, it is preferable for all of the indentations 39 to be the same size. As will be explained below, having indentations 39 be similar in size is advantageous due to the relationship between the locations of indentations 39 on side 14 to the locations of indentations 39 on side 16.

Figure 4:
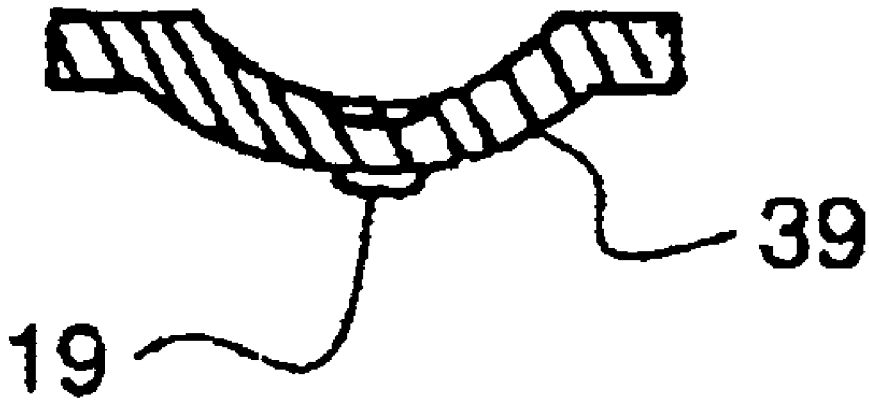
FIG. 4 is a partial cross-section view taken along section A—A in FIG. 3

The size of indentations 39 and the size of structural member 10 dictate the size and shape of a cross-section of indentations 39. When indentation 39 is semi-ellipsoidal in shape, a cross-section taken in a plane perpendicular to the longitudinal axis of the structural member 10 is generally semi-elliptical, as shown in FIG. 4. Likewise, for an alternative embodiment of indentations 39, the cross-section may also be semi-circular.

Figure 2:
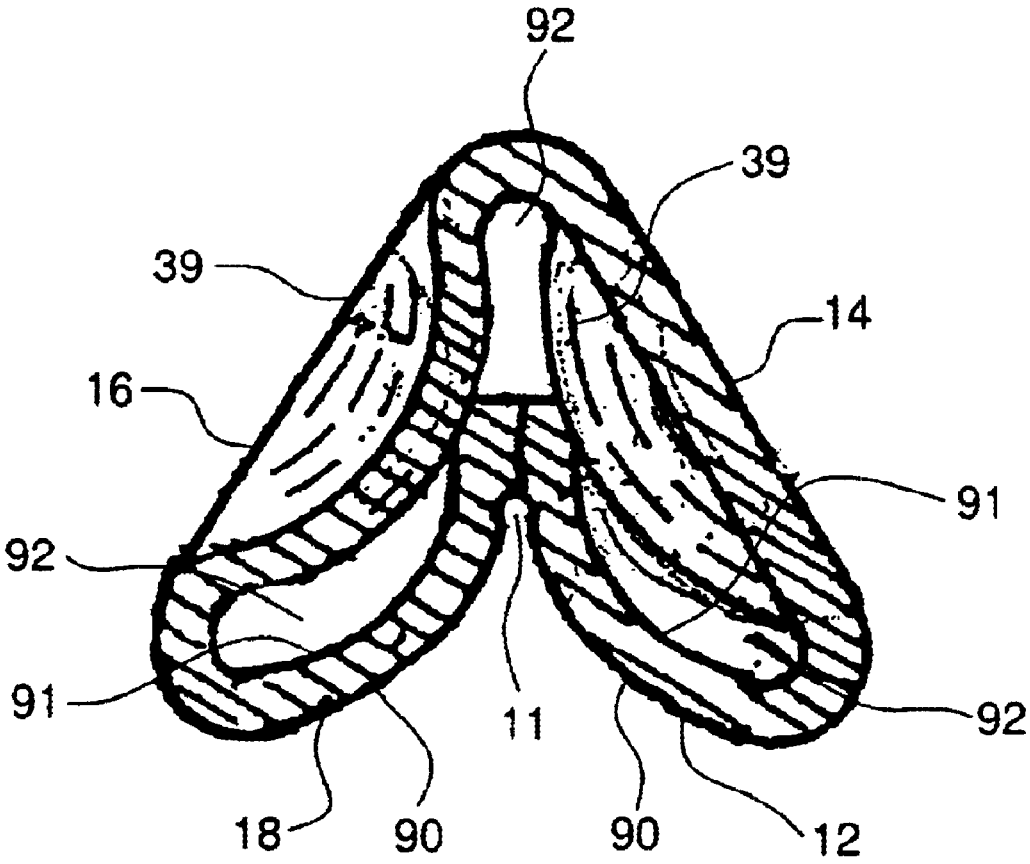
FIG. 2 is a cross-section view of the embodiment of FIG. 1.

As shown in FIG. 2, curved components 12 and 18 are generally equally sized sheets that bend inward from planar sides 14 and 16. Curved components 12 and 18 are uniformly curved around their longitudinal axis the entire length of structural member 10. Each curved component 12 and 18 has a generally concave inner surface 91 on the inside of structural member 10, and a generally convex outer surface 90 on the outside of structural member 10. As will be described in more detail below, when structural member 10 is formed, the outer surface 90 of curved component 12 and the outer surface 90 of curved component 18 join together in the internal region of triangular shaped structural member 10 to form the third side of the triangular shape. Thus, in a preferred embodiment, curved component 12 is a mirror image of curved component 18 in structural member 10.

As further shown in FIG. 2, structural member 10 has three internal cavities 92, each of which has an apex at each internal vertex of the triangular shape. Each of the three internal cavities 92 extends longitudinally for the entire length of structural member 10.

In a preferred embodiment, structural member 10 is made from high tensile steel, however, as would be known to one skilled in the art, any number of materials may be used for structural member 10. For example, structural member 10 may be fabricated from a single metal, a combination of metals, ceramics, plastics, polymers or combinations thereof. Likewise, as would be known to one skilled in the art, the thickness and size of structural member 10 will vary, and is determined by the specific structural properties required for each application.

In a preferred embodiment, restraining element 11 provides additional stability to the overall structure of structural member 10. Restraining element 11, located at the point where curved components 12 and 18 join, comprises a shaped element that provides a means to align and lock together curved components 12 and 18, and inhibits movement that would separate the two. In one embodiment, shown in FIG. 2, restraining element 11 comprises a concave channel in curved component 12 and a matching concave channel in curved component 18, which in structural member 10 is directly opposite the channel in component 12. A corresponding device, such as a rod, is then inserted into the channels comprising restraining element 11 in order to lock components 12 and 18 together and inhibit movement. However, in alternative embodiments, one skilled in the art would know of numerous shapes and mechanisms for restraining element 11 that would provide the additional stability to structural member 10.

Figure 3:
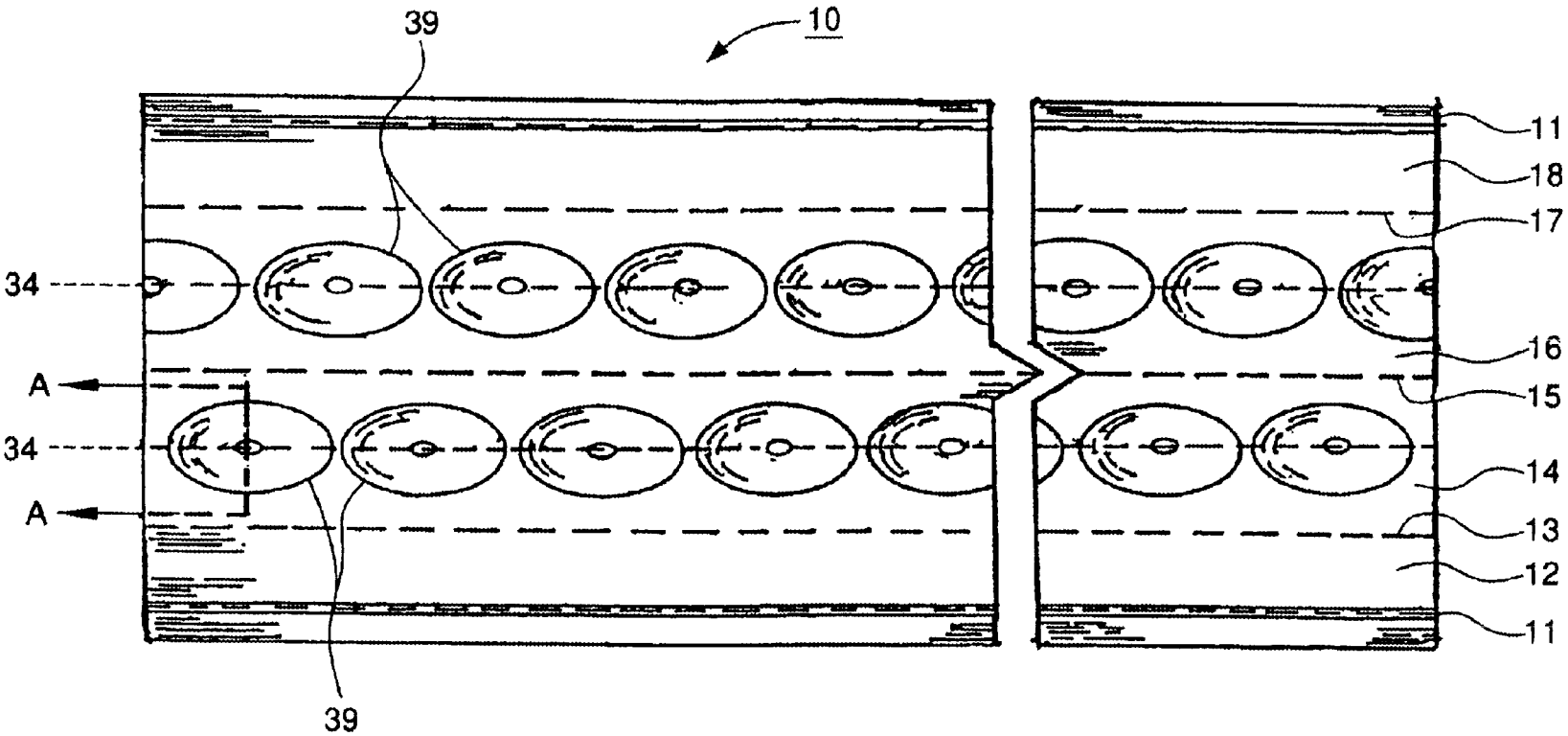
FIG. 3 is a plan view of the embodiment of FIG. 1 in a fully unfolded position.

In one embodiment, structural member 10 is constructed from a single flat sheet configured as shown in FIG. 3. Structural member 10 is formed into its generally triangular shape by folding planar sides 14 and 16 along folds 13, 15, and 17 in the direction parallel to the longitudinal axis of structural member 10 to form the two planar sides of the triangular shape. Curved components 12 and 18, including restraining element 11, are folded toward the internal region of the triangular shape of structural member 10, so that outer surface 90 of curved component 12 touches and joins to outer surface 90 of curved component 18, as shown in FIG. 2, at an approximately equal distance from planar sides 14 and 16 along the longitudinal axis of structural member 10. In this way, the joined curve components 12 and 18 together form the third side of the generally triangular shape of structural member 10.

In forming structural member 10, the single flat sheet is preferably folded, such that each internal vertex of the triangular shape is an angle ranging from a rounded bend, as shown in FIG. 1, to a sharp crease at each internal vertex. However, in the preferred embodiment, structural member 10 is formed with rounded bends at each fold 13, 15 and 17, creating each vertex.

As shown in FIG. 3, indentations 39 are semi-ellipsoidal in a preferred configuration, and arranged in a single line 34 on planar sides 14 and 16, running parallel to the longitudinal axis of structural member 10 for its entire length. Each indentation 39 in planar side 16 is offset, in a plane perpendicular to the longitudinal axis, from each indentation 39 in planar side 14 by one half the distance between the centers of each indentation. In other words, in each case, in the plane perpendicular to the longitudinal axis of structural member 10, the outside edge of each indentation 39 on side 14 is aligned with the centerline bisecting each indentation 39 on side 16. In a preferred embodiment, as viewed in FIG. 3, indentations 39 are located on structural member 10 so that the centerline of an indentation 39 falls at the edge of each end of either side 14 or 16 of structural member 10. The depth of each indentation 39 is such that when structural member 10 is folded in its final form, the convex bulge of each indentation 39 on the inner surface of sides 14 and 16, respectively, contacts the concave inner surface 91 of curved components 12 and 18, respectively, at the point where components 12 and 18 join.

In an alternative embodiment, the outside tangent point of each indentation 39 has an embossed projection 19, as shown on FIG. 4. Surface projection 19 restricts torsional flexibility of curved components 12 and 18 of structural member 10, and helps align curved components 12 and 18 within the internal region of structural member 10. On structural member 10, embossed projection 19 on each indentation 39 on planar side 14 contacts inner surface 91 of curved component 12, and embossed projection 19 on each indentation 39 on planar side 16 contacts inner surface 91 of curved component 18.

The triangular shape of structural member 10 provides torsional flexibility to the member. With one end of structural member 10 held rigidly, the other end can be rotated about the longitudinal axis of structural member 10, i.e., around an axis parallel to each one of folds 13, 15 and 17. When structural member 10 is twisted in this manner, indentations 39 slide against curved components 18 and 12 while maintaining contact therewith. This contact helps prevent failure of structural member 10 during twisting, thereby adding to the range of rotation tolerated by structural member 10.

Indentations 39 also lend structural rigidity to each side 14 and 16 of structural member 10 by interrupting the planar face of the side. Thus, increased strength and rigidity is provided with respect to forces applied perpendicular or parallel to the longitudinal axis of structural member 10, while rotational and torsional flexibility is also increased.

Structural member 10 may be fabricated or manufactured in several different ways. Likewise, structural member 10 is made in any size, using metal or other materials of the appropriate thickness for a particular application. For example, die stamping a continuous sheet of metal with indentations 39 can be used to form sheets as shown in FIG. 3. The sheets are then folded at folds 13, 15, and 17 to form triangular shaped structural member 10 as described above. Alternatively, sheets such as those shown in FIG. 3 may be made by spray depositing droplets of steel or other metal onto a moving ceramic form. The sheets are formed to the thickness required and then folded into triangular structural member 10. In the alternative, structural member 10 may be formed by other methods known to those skilled in the art.

In one embodiment, structural member 10 is made by molding a durable material, such as a synthetic polymeric resin, in a machined mold. For small members of definite length, injection blow molding is an appropriate fabrication method. Extrusion blow molding may also be used to produce structural member 10. Alternative fabrication methods known to those skilled in the art may also be used.

Figure 5:
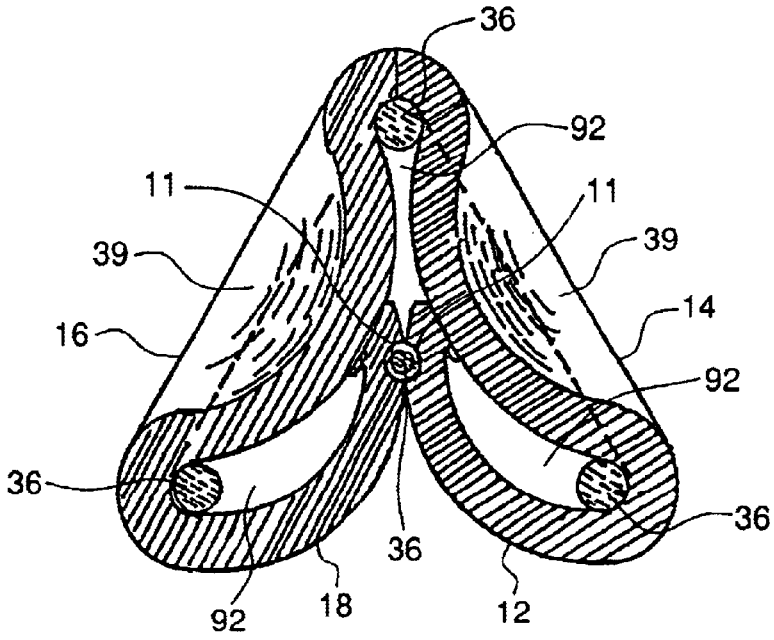
FIG. 5 is a cross-section view of another preferred embodiment of a structural member of the present invention.

FIG. 5 shows a cross section of another preferred embodiment of structural member 10. In this embodiment, stabilizing rods 36 add stiffness and strength to structural member 10. Each of a first, second and third stabilizing rod 36 are located in the apex of each cavity 92 within structural member 10, and extend longitudinally through structural member 10 for the entire length of structural member 10. A fourth stabilizing rod 36 is located within restraining element 11, as shown in FIG. 5, and extends the entire length of structural member 10. First, second and third stabilizing rods 36 are sized for each structural member 10 to fit snugly inside the apex of each cavity 92. Similarly, the channels of restraining element 11 and the fourth stabilizing rod 36 are sized to mate with each other and to fit within each curved component 12 and 18 of each structural member 10. Stabilizing rods 36 are preferably made of high tensile steel, graphite fiber, fiberglass or a resin composite, and are crimped or clamped in place within structure member 10 after it is formed. However, stabilizing rods 36 may also be made of alternative materials as known to those skilled in the art for reinforcing purposes.

Figure 6:
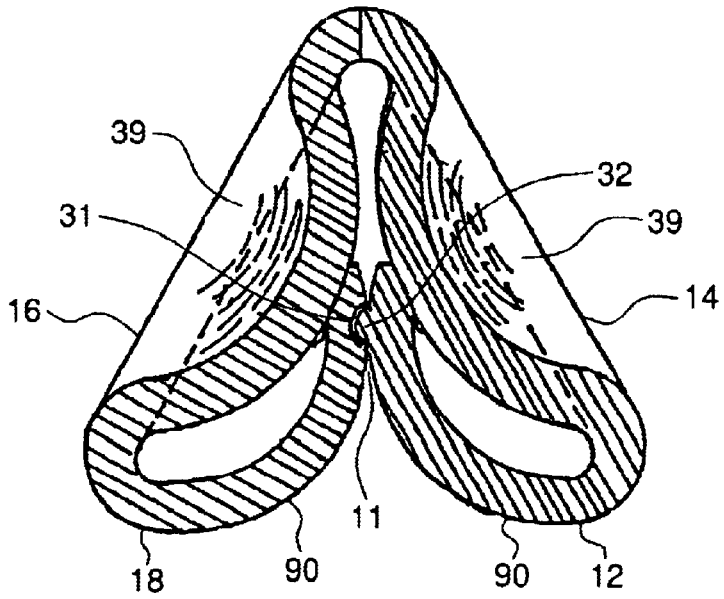
FIG. 6 is a cross-section view of another preferred embodiment of a structural member of the present invention.

FIG. 6 shows yet another preferred embodiment of structural member 10 in which the external surfaces 90 of curved components 12 and 18 comprise an alternative embodiment of restraining element 11. As shown in FIG. 6, external surface 90 of curved component 12 has convex bulge 32 extending longitudinally for the entire length of curved component 12, and external surface 90 of curved component 18 has concave channel 31 extending longitudinally for the entire length of curved component 18. When curved components 12 and 18 are folded into the interior region of structural member 10, convex bulge 32 and concave channel 31 are aligned and mate together. Thus, external surfaces 90 of curved components 12 and 18 are locked together. Accordingly, when curved components 12 and 18 are joined at bulge 32 and channel 31 additional strength is added to structural member 10.

Figure 7:
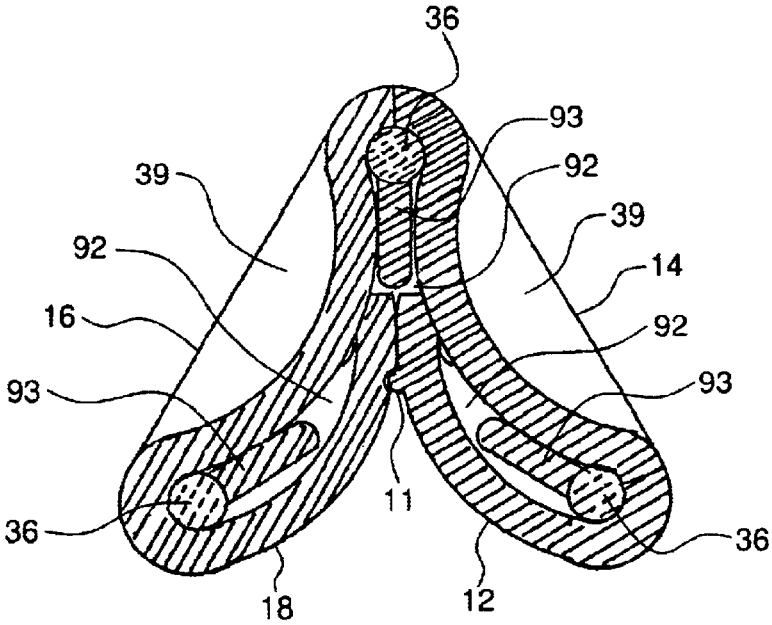
FIG. 7 is a cross-section view of another preferred embodiment of a structural member of the present invention.

Yet another preferred embodiment of structural member 10 is shown in FIG. 7. This alternative embodiment has a first, second and third stabilizing rod 36, each of which is inserted at the apex of each internal cavity 92 as shown in the embodiment in FIG. 5 and an embodiment of restraining element 11 as shown in FIG. 6. In addition, a first, second and third insert 93 is located in each internal cavity 92. Each insert 93 is sized to fit adjacent to each stabilizing rod 36 within each internal cavity 92, and extend longitudinally for the entire length of structural member 10. Each insert 93 is placed in each cavity 92 after each stabilizing rod 36 is installed. Each insert 93 is fit into each cavity 92 to hold each stabilizing rod 36 in place within the cavity when structural member 10 is pre-stressed during fabrication. As would be known to one skilled in the art, in alternative embodiments, a variety of shapes for insert 93 are available that would adequately secure each stabilizing rod 36 in place. The material used for insert 93 may be any material known to those skilled in the art depending on particular application or use of structural member 10.

Figure 8:
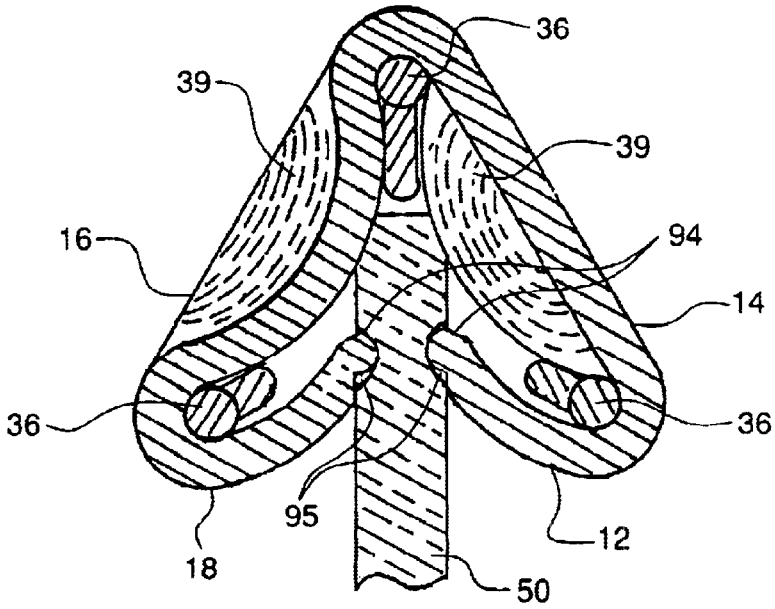
FIG. 8 is a cross-section view of another preferred embodiment of a structural member of the present invention.

The shape of structural member 10 also provides alternate methods for assembling structural members to each other, and for assembling structural members to other structures, such as panels and boxes, in many structural application. For example, many containers are made of a series of panels held together by multiple structural members. The preferred embodiment of structural member 10, shown in FIG. 8, supports prefabricated panels 50 for a container assembly having panel walls. In this embodiment, curved components 12 and 18 are shortened so that they do not join together in the internal region of structural member 10. Thus, a short edge of each curved component 12 and 18 is located in the internal region of structural member 10. The short edge of each curved component 12 and 18 is a rounded edge 94. Panel 50 has a rectangular cross-section with a first and second long side and a first and second short side. A first short side of panel 50 is installed into the internal region of structural member 10 between curved components 12 and 18, so that a portion of each long side of panel 50 is compressed between indentations 39 of sides 14 and 16. The long sides of panel 50 are then held in place by curved components 18 and 12. Each long side of panel 50 has a channel 95 sized and shaped to correspond to rounded edge 94. Each channel 95 extends the entire length of panel 50 in the direction of the longitudinal axis of structural member 10. When panel 50 is installed in structural member 10, rounded edge 94 of curved component 12 is locked into channel 95 on the first long side of panel 50, and rounded edge 94 of curved component 18 is locked into channel 95 on the second long side of panel 50. Thus, panel 50 is locked to structural member 10.

This simplified method of assembly allows easy replacement of prefabricated panels 50. To replace panel 50 curved components 12 and 18 are deformed to release rounded edges 94 from channels 95. Panel 50 is removed, and new panel 50 is installed. In this way, rounded edges 94 of structured member 10 act as tabs that snap and lock panels 50 into position when installed. Channels 95 are sized and located on panel 50 to provide adequate clearance to allow panel 50 to slide into structural member 10 and lock in place. This also restricts the four way movement of panel 50. As would be known to one skilled in the art, various configurations of ends for curved components 12 and 18 and corresponding mating elements in each panel 50 may be used.

Many uses of structural member 10 in construction and fabrication applications require attaching and assembling two or more structural members 10 together. In preferred embodiments, structural members 10 are assembled together without welding. Along with an easier means of assembly, non-welding methods eliminate the concern for dangerous stress fractures due to welding.

Figure 9:
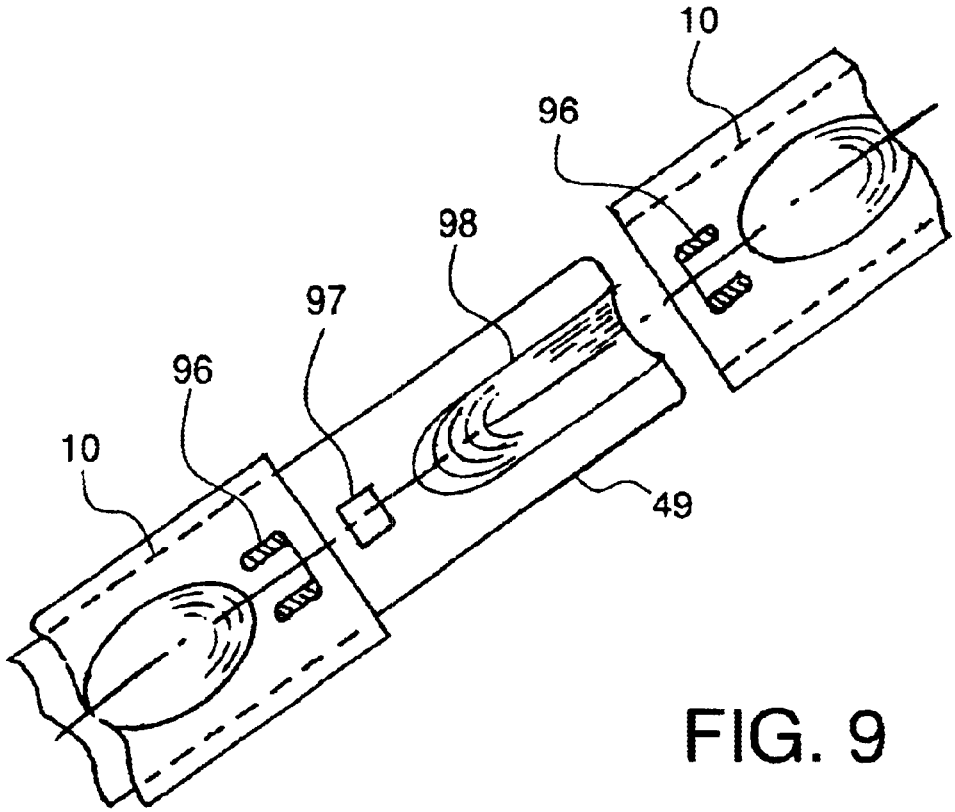
FIG. 9 shows a preferred embodiment of two structural members and a joining adapter for joining the structural members.
Figure 10:
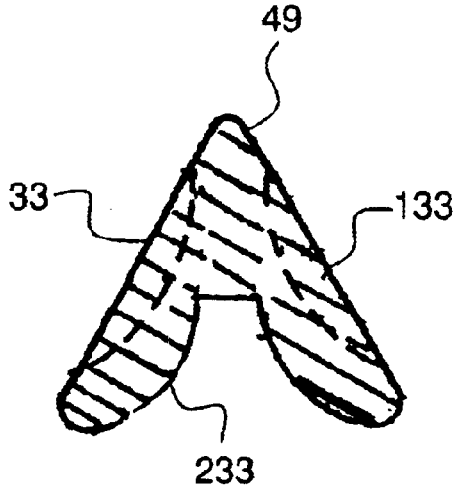
FIG. 10 shows a cross section view of the adapter of FIG. 9.

A preferred embodiment shown in FIG. 9 provides a method of joining two structural members 10 together along their longitudinal axis. In lieu of a welded joint, this method uses a type of tab arrangement to lock two structural members 10 together. A first and second sleeve 96 have a common centerline with a centerline of each planar side 14 and 16 of structural member 10, but are located on structural member 10 near the ends of each planar side 14 and 16. The centerline of each sleeve 96 is aligned with the longitudinal centerline of indentations 39. Each sleeve 96 protrudes into the internal region of the triangular shape of structural member 10. Joining adapter 49 is a solid insert shaped to fit inside the internal region of structural member 10. As shown in FIG. 10, adapter 49 is generally triangular in shape having the same longitudinal axis as structural member 10. Adapter 49 has a first planar side 33 and second planar side 133 forming a first and second side, respectively, of the triangular shape. Each planar side 33 and 133, respectively, has an outer surface that fits inside the inner surface of each side 14 and 16, respectively, of structural member 10. Adapter 49 has a third shaped side 233 that is shaped to fit inside the corresponding third side of structural member 10. On each planar side 33 and 133 is a recess 97 in the outer surface located near each opposing end of each planar side 33 and 133. The size and shape of each recess 97 depends on the size and shape of each sleeve 96 in structural member 10. As shown in FIG. 9, each sleeve 96 of each structural member 10 slides into recess 97 of joining adapter 49. Each sleeve 96 locks each recess 97 in place.

To attach two structural members 10 together, joining adapter 49 is installed as described between two structural members 10, and each sleeve 96 of each structural member 10 is locked into a corresponding recess 97 of joining adapter 49. Joining adapter 49 also has groove 98, which is sized and located to correspond to indentations 39 of structural member 10. Groove 98 allows joining adapter 49 to slide over at least one indentation 39 on the inner surface of sides 14 and 16 during the assembly of joining adapter 49 and structural members 10. The longitudinal length of adapter 49 is sized to mate with at least one sleeve 96 in one structural member 10 and a second sleeve 96 in a second structural member 10.

Structural members 10 are joined by sliding joining adapter 49 into a first structural member 10 so that groove 98 slides over at least one indentation 39 and sleeve 96 of the first structural member 10 locks into recess 97 of adapter 49. The opposite end of adapter 49 is then inserted into a second structural member 10. Sleeve 96 of the second structural member 10 is locked into recess 97 on the opposite end of adapter 49. Thus, adapter 49 locks two structural members 10 to each other. The material of joining adapter 49 must be compatible with structural member 10 and must provide sufficient strength to hold together two structural members 10 in each specific application. As one skilled in the art would know, various materials are available that would provide sufficient strength for each specific application.

Figure 12:
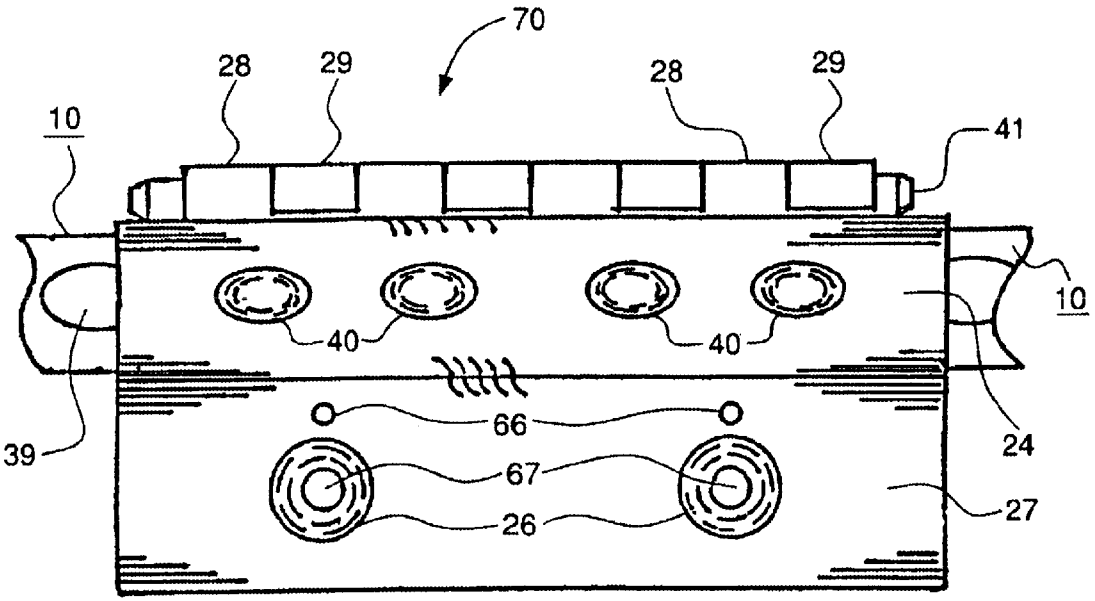
FIG. 12 is a side view of the embodiment of FIG. 11.
Figure 11:
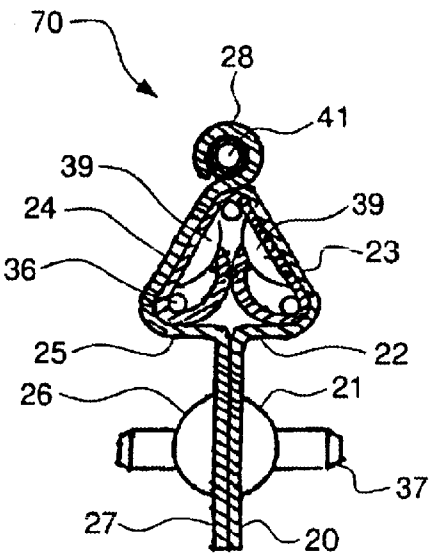
FIG. 11 is a cross section view of a preferred embodiment having two structural members joined within a fully assembled joining clamp.

In addition to assembling two or more structural members 10 along their longitudinal axis using joining adapter 49, FIGS. 11 and 12 show an alternative preferred embodiment using joining clamp 70 to assemble two or more structural members 10 together. Joining clamp 70 allows two or more structural members to be assembled to each other, or to other structural elements, in configurations other than along their longitudinal axis. Joining clamp 70 has right hand bracket 51 and left hand bracket 52 that are formed, such that when right hand bracket 51 and left hand bracket 52 are joined together, joining clamp 70 encloses structural member 10.

As shown in FIG. 13 unfolded right hand bracket 51 is generally a rectangular sheet 53, having a long side and a short side, and also having tabs 29 extending outward from the edge of the long side of rectangular sheet 53. Similarly, as shown in FIG. 14 unfolded left hand bracket 52 is generally a rectangular sheet 54, having a long side and a short side, and also having tabs 28 extending outward from the edge of the long side of rectangular sheet 54. Right hand bracket 51 is folded at folds 35 to form vertical lower portion 20, having an inside surface and outside surface, horizontal middle portion 22 and slanted upper portion 23, as shown in FIG. 11. Left hand bracket 52 is folded at folds 35 to form vertical lower portion 27, having an inside surface and outside surface, horizontal middle portion 25 and slanted upper portion 24, as shown in FIG. 11.

To form clamp 70 for structural member 10, right hand bracket 51 and left hand bracket 52 are placed together as shown in FIG. 11, such that the inside surface of vertical lower portion 20 is adjacent to the inside surface of vertical lower portion 27, and horizontal middle portions 22 and 25, respectively, extend in opposite directions outward from vertical lower portions 20 and 27. When right hand bracket 51 and left hand bracket 52 are assembled together, horizontal middle portions 22 and 25 and slanted upper portions 23 and 24 together form a generally triangular shape. The thus formed triangular shape surrounds structural member 10. Tabs 29 of right hand bracket 51 and tabs 28 of left hand bracket 52 are aligned alternately along a straight line parallel to the long side of right hand bracket 51 and left hand bracket 52, as shown in FIG. 12. Tabs 29 and 28 are bent to create an open cylinder shape as shown in FIG. 11. Then locking pin 41 is inserted through the inside of the thus formed open cylinder shape. Locking pin 41 holds tabs 28 and 29 in position and restricts forces that attempt to separate right hand bracket 51 and left hand bracket 52 of assembled joining clamp 70.

As shown on FIGS. 13 and 14, slanted upper portion 23 of right hand bracket 51 and slanted upper portion 24 of left hand bracket 52, respectively, have a number of indentations 30 and 40, respectively. The size, shape and location of indentations 30 and 40 are used to position joining clamp 70 around structural member 10, so that indentations 30 and 40 in joining clamp 70 are mated with the indentations 39 in structural member 10 (See FIG. 11). Any number of indentations 30 and 40 may be used depending on the longitudinal length of right hand bracket 51 and left hand bracket 52.

Figure 15:
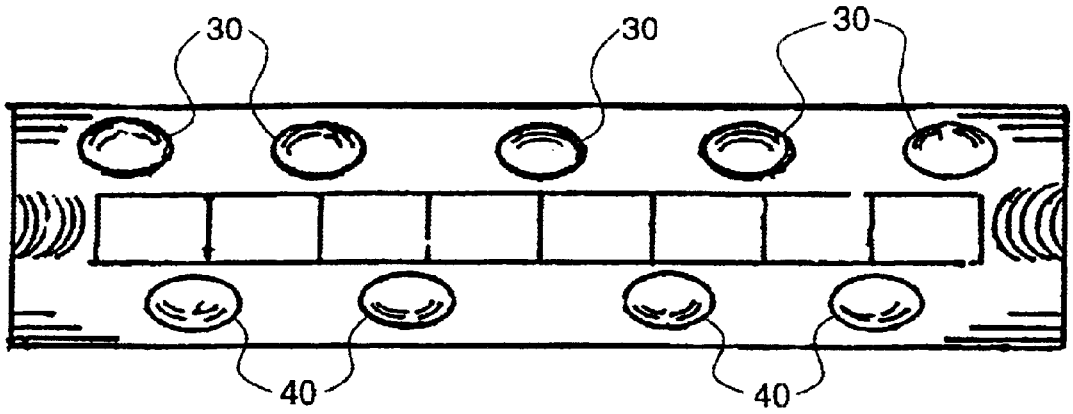
FIG. 15 is a top view of the embodiment of the joining clamp of FIG. 11.

In a preferred embodiment, the longitudinal length of joining clamp 70 is such that between two and ten indentations 39 are engaged with each of indentations 30 on right hand bracket 51 and indentations 40 on left hand bracket 52, preferably between three and eight of each, and most preferably at least four of each. FIG. 15, providing a top view of assembled joining clamp 70, shows that indentations 30 are arranged in a straight line offset from indentations 40. The depth of indentations 30 and 40 and matching indentations 39 in structural member 10 are designed to allow expansion and contraction of the joined structural members 10. Indentations 30 and 40 also ensure that right hand bracket 51 and left hand bracket 52 can not be inadvertently reversed. Each right hand bracket 51 and left hand bracket 52 has alignment holes 66. As shown in FIG. 14, when joining clamp 70 is properly assembled, holes 66 in right hand bracket 51 and left hand bracket 52 align with each other to ensure that right hand bracket 51 and left hand bracket 52 are properly aligned.

Returning to FIGS. 11 and 12, vertical lower portions 20 and 27 comprise hemispherical protrusions 21 and 26 respectively. In a preferred embodiment two hemispherical protrusions 21 and 26 are shown. However, any number of protrusions 21 and 26 may be used depending on the length of joining clamp 70. Each hemispherical protrusion has a hole 67 located generally in the center. An extended stud 37, having a longitudinal centerline, is fed through hole 67 of hemispherical protrusions 21 and 26, as shown in FIG. 11. Locking pins in any number of configurations may then be inserted through extended stud 37 perpendicular to its centerline to prevent the movement or release of extended stud 37. Thus, when extended stud 37 is locked in place, a mechanism is provided to lock vertical lower portions 20 and 27 of joining clamp 70 together to further restrict the separation of brackets 51 and 52.

Joining clamp 70 is also used to join structural member 10 to one or more support braces, such as panels or other structural members. For example, in a preferred embodiment, support braces or other structural members are mounted on extended stud 37 adjacent to protrusions 21 and 26 and held in place by a locking pin. One or more support braces are fabricated, each having an inner surface and an outer surface, with a recess on the inner surface that mates with hemispherical protrusions 21 or 26 and a hole that aligns with hole 67. The brace is installed on protrusion 21 or 26 and extended stud 37 is inserted through hole 67 in joining clamp 70 and the corresponding hole in the support brace. A locking pin is installed on extended stud 37 adjacent to the outer surface of the support brace to lock the support brace against joining clamp 70.

Joining clamp assembly 70, as shown in FIGS. 11 and 12, is located at any number of locations along the longitudinal length of structural member 10. Multiple joining clamps 70 can join multiple braces or structural elements to create truss assemblies. Through the use of joining clamp 70, structural members 10 can be used in conjunction with braces to construct any number of truss assemblies. This method of joining structural members to each other and to other braces eliminates the need for the dangerous welding of connections and provides an easy method of assembly and disassembly.

Many alternative configurations of truss assemblies are possible using clamp assembly 70. Thus, intricate lattice assemblies may be formed to create a structure, which can be used in construction. For example, in one embodiment, two structural members 10, each having an installed clamp assembly 70, are aligned at 45 degrees from each other. A first clamp assembly 70 on a first structural member 10 and a second clamp assembly 70 on a second structural member 10 are located on each structural member 10 near the point where the structural members 10 meet. Each clamp assembly 70 is installed on each structural members 10 so that combined lower vertical portions 20 and 27 of the first clamp assembly 70 are oriented towards the combined vertical lower portions 20 and 27 of the second clamp assembly 70, and are on the same plane as each other. Thus, the combined lower vertical portion 20 and 27 of the first clamp assembly 70 is oriented 45 degrees from combined lower vertical portion 20 and 27 of the second clamp assembly 70. A connecting member or support brace is installed on each of first clamp assembly 70 and second clamp assembly 70, respectively, wherein the brace is at a 45 degree angle between clamp assemblies 70 thereby securing structural members 10 in a position at 45 degrees from each other. Clamp assemblies 70 may thus be used to join two or more structural members 10, or to connect structural members 10 to support braces in any number of configurations.

As would be known to one skilled in the art, any number of shapes and configurations could be used for protrusions 21 and 26 and for the corresponding shapes in a mating brace or panel. Additionally, in alternative embodiments, extended rod 37 and the associated locking pin is replaced by a threaded rod. As one skilled in the art would known, any number of configurations may be used to lock one or more braces to joining clamp 70.

Figure 16:
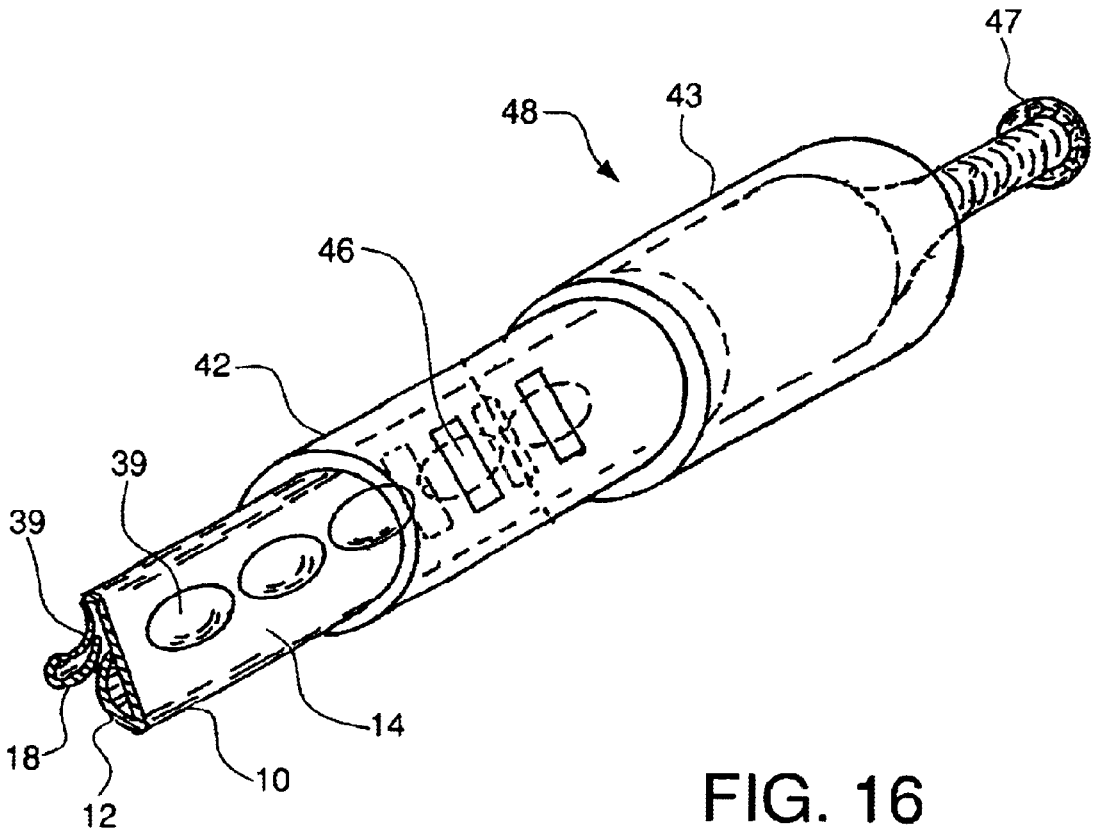
FIG. 16 is a perspective view of a preferred embodiment of a cylinder clamp assembly and a structural member.
Figure 17:
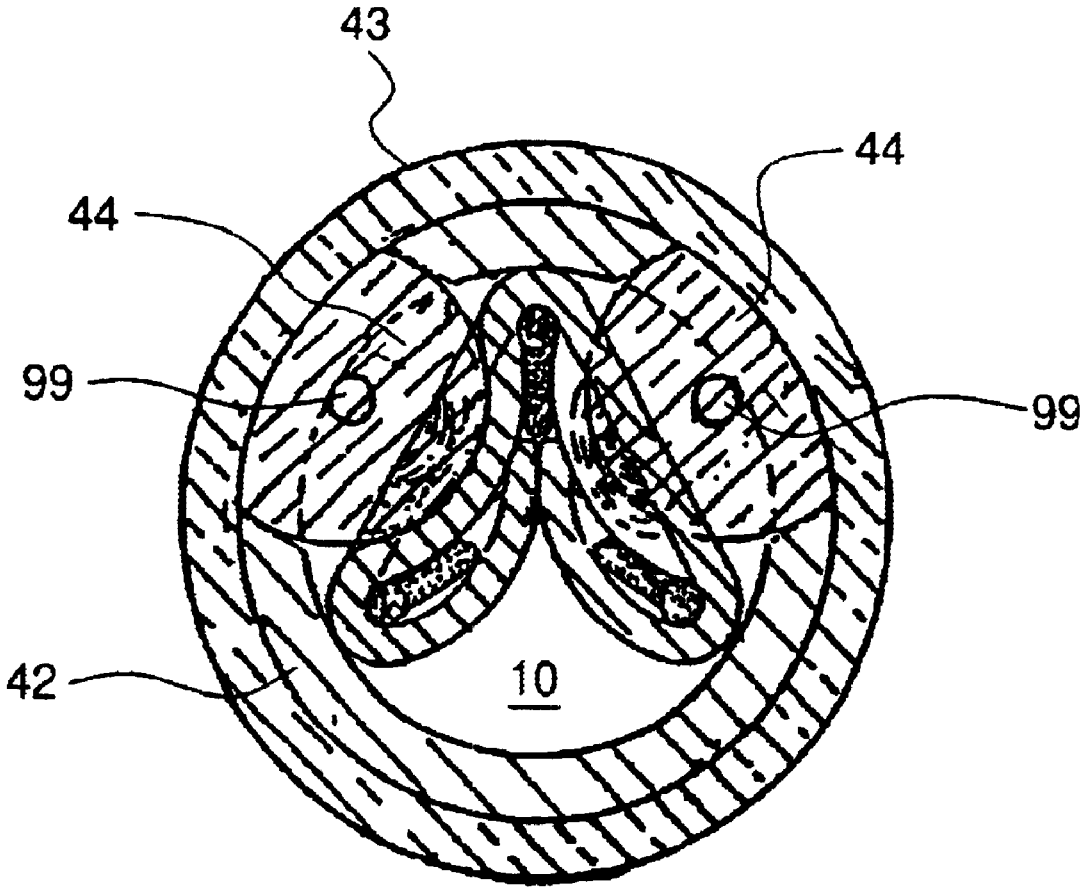
FIG. 17 is a cross section view of a cylinder clamp assembly and structural member of FIG. 16.

Turning now to FIGS. 16 and 17 that show another embodiment for assembling together one or more structural members 10, and for using structural members 10 in other assemblies. FIG. 16 shows a partially assembled cylinder clamp assembly 48 used with structural member 10. Along with a means for assembling two or more structural members 10, cylinder clamp assembly 48 measures the outside diameter and gauges the straightness of structural member 10 and the depth and center location of indentations 39. In this way, cylinder clamp assembly 48 may also be used as a hand-held quality control and inspection tool.

Cylinder clamp assembly 48 comprises internal cylinder 42, external cylinder 43 and retainers 44. Internal cylinder 42, having an inside surface and an outside surface and also having rectangular slots 46 is placed around one or more structural members 10. Slots 46 are aligned with semi-ellipsoidal indentations 39 in structural members 10. Slots 46 are sized according to the size of internal cylinder 42 and indentations 39 in structural member 10 to allow the proper installation of retainers 44 through internal cylinder 42 into structural members 10. Two or more retainers 44 are installed in slots 46 in internal cylinder 42. Retainers 44 are shaped, such that the inner surface of retainers 44 is fit into the center of indentations 39 of structural members 10 as shown in FIG. 17. External cylinder 43 having an inside surface and an outside surface is sized to snugly fit around internal cylinder 42. The outer surface of retainers 44 is shaped to mate with the inside surface of external cylinder 43. As external cylinder 43 is advanced onto internal cylinder 42, retainers 44 and structural member 10 are locked in place. External cylinder 43 may then be aligned and rotated to verify measurements of structural members 10.

Retainers 44 have an internally located hole 99. In a preferred embodiment, hole 99 is located in the center of retainer 44, however, in alternative embodiments, hole 99 may be located at other locations in retainer 44. Hole 99 allows expansion and contraction of retainer 44 for the environmental conditions for a particular application. Thus, hole 99 allows for clearance and variations in tolerances to permit movement of external cylinder 43 over retainers 44. The clearance between retainers 44 and external cylinder 43 also allows structural member 10 to expand or contract within internal cylinder 42.

Internal cylinder 42 is sized to properly fit around structural member 10 and hold retainers 44. Accordingly, the inside diameter dimension of internal cylinder 42 is only slightly larger than the external dimension of structural member 10. The external dimension of structural member 10 is two times the radial dimension of structural member 10, wherein the radial dimension of structural member 10 is defined herein as the distance from the true center of structural member 10 to its outside apex. In a preferred embodiment, the inside diameter dimension of internal cylinder 42 is at least 1.02 times the external dimension of structural member 10. Additionally, the minimum outside diameter dimension of internal cylinder 42 is three times the radial dimension of structural member 10. The minimum longitudinal length of internal cylinder 42 is five times the longitudinal distance between the centers of each indentation 39 of structural member 10. However, the inside and outside diameters, and the length of internal cylinder 42 may vary depending on the particular application.

As with internal cylinder 42, which fits around structural member 10, external cylinder 43 must be sized to properly fit around internal cylinder 42 and lock retainers 44 in place. Accordingly, the inside diameter dimension of external cylinder 43 is only slightly larger than the outside diameter dimension of internal cylinder 42. In a preferred embodiment, the inside diameter of external cylinder 43 is at least 1.01 times the outside diameter of internal cylinder 42. The minimum outside diameter dimension of external cylinder 43 is four times the radial dimension of structural member 10. The length of external cylinder 43 is sized to properly mate with internal cylinder 42. As with internal cylinder 42, the inside and outside diameters, and the length of external cylinder 43 may vary depending on the application.

An optional element, such as handle 47, may be added to allow easier use and handling of the cylinder clamp assembly 48 as a quality control or inspection tool. The materials of internal cylinder 42, external cylinder 42 and retainers 44 of cylinder clamp assembly 48 must be compatible with the material of structural members 10, and provide the material properties required for a specific application. One skilled in the art would be aware of various materials that would provide the material properties needed for each specific application. Additionally, as would be known to one skilled in the art, cylinder clamp 48 may be manufactured by various methods. For example, in a preferred embodiment cylinder clamp assembly 48 is a steel material manufactured by cold extrusion and then hardened to provide increased tensile strength.

A method of combining two or more structural members 10 along the longitudinal axis using an adapter located internally within structural member 10, such as the adapter shown in FIG. 9, provides quick and easy assembly of shorter lengths of structural members 10 into extended support assemblies. Additionally, since the adapter is located internally to structural member 10, even when two or more structural members are assembled together, no external obstructions to the outside surface of structural members 10 are created. The easy assembly of numerous structural members 10 advantageously allows structural member 10 to be used in conditions that require quick assembly of a structurally sound, assembly that may be then disassembled and transported to another location.

Figure 18:
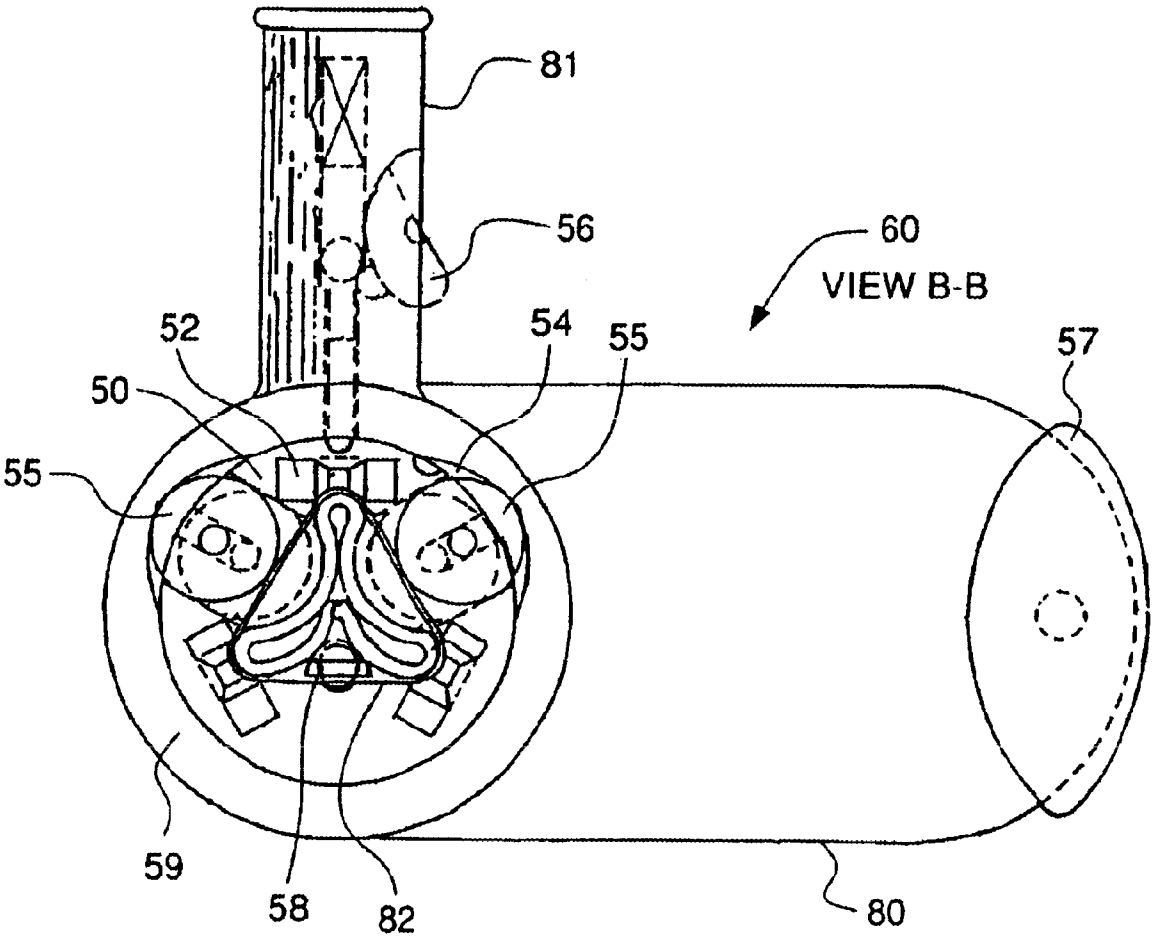
FIG. 18 is a top view of a clamp assembly using a structural member.
Figure 19:
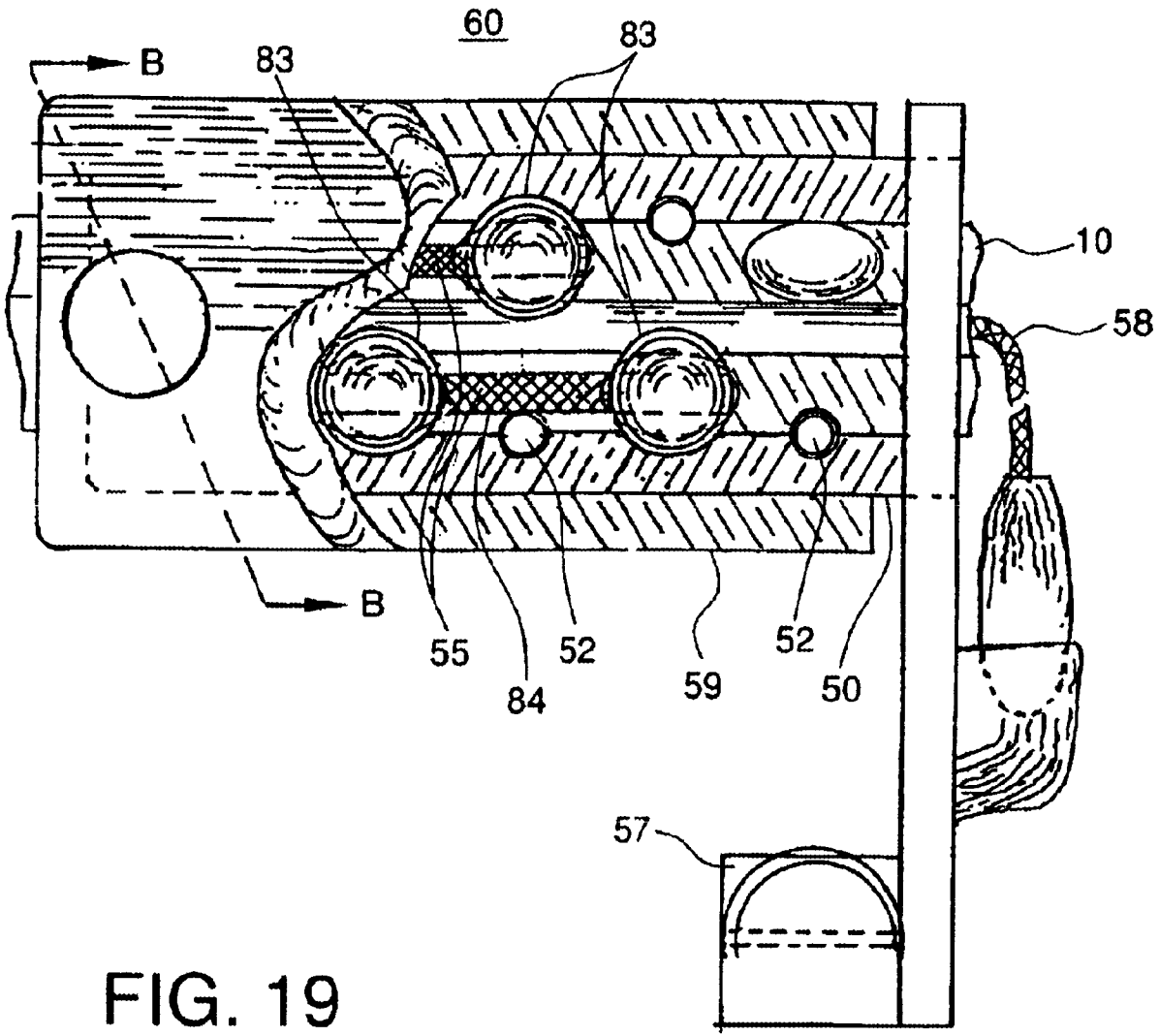
FIG. 19 is a cross section view of a clamp assembly using a structural member.

For example, in an alternative embodiment, structural member 10 is used in a support and rescue assembly device that provides a single light weight, easily erected, trustworthy tool. In this embodiment, which will be described in more detail below, one or more structural members 10 are assembled and erected with the longitudinal axis in a vertical direction. Clamp 60, using a hand and foot mechanism incorporating structural member 10 as shown in FIGS. 18 and 19, allows an operator/rescuer to ascend or descend along the smooth outside surface of structural member 10. In operation, two structural members 10 are erected adjacent to each other. Clamp 60 is installed on each structural member 10. The operator/rescuer stands on foot support 80 of each clamp 60, and moves incrementally along each structural member 10 by alternately adjusting handle 81 on each clamp 60 to travel along each structural member 10. The movement of handle 81 alternately clamps and releases clamp 60 on structural member 10. Clamp 60 also includes a wire cable brake 58 that enables the operator to control the free release or the speed of descent along structural member 10.

Clamp 60 has handle 81, outside cylinder 59 attached to handle 81, retaining ball assemblies 55 and internal cylinder 50, and foot support 80 attached to internal cylinder 50. While standing on foot support 80, as an operator turns handle 81 outside cylinder 59 is rotated. The rotation of outside cylinder 59 causes retaining ball assemblies 55 to be pressed against, and then released from, structural member 10. The pressing and releasing of clamp 60 to structural member 10 incrementally moves clamp 60 along structural member 10.

In a preferred embodiment, foot support 80 holds the operator, and is sized for each particular application. Foot support 80 is sized to provide the operator with sufficient surface on which to stand, and is of sufficient thickness to support the weight required for each application. Likewise, the shape of foot support 80 may vary depending on the specific application. Additionally, as would be known to one skilled in the art, the material of foot support 80 must be compatible with the material of internal cylinder 50 and must support the load for each application.

Referring to FIGS. 18 and 19, internal cylinder 50 is a solid cylinder with a centrally located open triangular shaped core 82. Triangular core 82 surrounds structural member 10 so that structural member 10 slides within triangular core 82. Accordingly, the inside dimensions of triangular core 82 are only slightly larger than the outside dimensions of structural member 10. In a preferred embodiment, the inside dimensions of triangular core 82 is at least 1.013 times larger than the outside dimensions of structural member 10.

Internal cylinder 50 has internally mounted bearings 52. Bearings 52 support structural member 10 within triangular core 82. Bearings 52 are located at right angles to the apexes of the internal triangular core 82 so that structural member 10 slides effortless along bearings 52 within triangular core 82. The number and placement of bearings 52 in the longitudinal direction required for each internal cylinder 50 depends on the specific size and configuration of internal cylinder 50. For example, in one embodiment, bearings 52 are mounted in a line parallel to the longitudinal axis of structural member 10 halfway between each indentation 39 of structural member 10. Likewise, as would be known to one skilled in the art, various designs and sizes of bearings 52 would be acceptable depending on the particular application. In the preferred embodiment shown on FIG. 18, bearings 52 are pin bearings.

The diameter and length of internal cylinder 50 depend on the size of structural member 10 and the particular application. In a preferred embodiment, the minimum outside diameter dimension of internal cylinder 50 is four times the radial dimension of structural member 10. Also, in a preferred embodiment the minimum length of internal cylinder 50 is five times the longitudinal distance between the centers of each indentation 39 of structural member 10.

Internal cylinder 50 also has cavities for installing retaining ball assemblies 55. The clamping mechanism of clamp 60 is accomplished by the movement of retaining ball assemblies 55. Retaining ball assemblies 55 pass through internal cylinder 50 into core 82 and press into indentations 39 of structural member 10 to prevent structural member 10 from sliding along core 82, thereby tightening clamp 60 on structural member 10. Retaining ball assembly 55 has two or more retaining balls 83 connected together by cable 84 as shown in FIG. 19. In a preferred embodiment, cable 84 is sized to match the diameter of retaining ball 83, and to provide adequate clearance for the required pressing and releasing motion. In a preferred embodiment, retaining balls 83 are steel and cable 84 is steel wire, however, multiple variations of retaining ball 83 materials and sizes, and associated cable 84 material and sizes, would be suitable as would be known to one skilled in the art.

Retaining ball assemblies 55 are pressed against structural member 10 by outside cylinder 59. Outside cylinder 59 is a solid cylinder having a longitudinal axis, an internal surface and an external surface, and linear cam recesses 54 located on the internal surface. Retaining ball 83 of retaining ball assemblies 55 is installed within each linear cam recess 54. Each linear cam recess 54 is sized to provide the clearance and tolerances required to move retaining ball 83 for a particular application. In a preferred embodiment, the clearance for retaining ball 83 inside linear cam recess 54 is a minimum of at least 1.015 times the outside diameter of retaining ball 83. However, one skilled in the art would be aware of alternative dimensions that would provide the required clearances. The distance along the longitudinal axis between the centers of each linear cam recess 54 in outside cylinder 59 is equal to the distance along the longitudinal axis between the centers of each indentation 39 of structural member 10. Retaining ball 83, installed in linear recess 54, is set in each indentation 39 of structural member 10. As external cylinder 59 is rotated around its longitudinal axis, each retaining ball 83 moves within each linear recess 54 causing the linear movement of retaining ball 83. Thus, retaining ball 83 moves linearly into, and out of, indentation 39 in structural member 10. A light manual force is needed to overcome the spring return forces of retaining ball 83 inside indentation 39. Thus, when retaining ball 83 is pressed into indentation 39 of structural member 10, structural member 10 is prevented from sliding along triangular core 82.

The size and length of outside cylinder 59 for a particular application depend on the size and length of internal cylinder 50. The inside diameter of outside cylinder 59 is sized to allow adequate tolerances for movements from environmental conditions causing expansion and contraction, while allowing outside cylinder 59 to rotate on inside cylinder 50. In a preferred embodiment, the inside diameter dimension of outside cylinder 59 is at least 1.01 times the outside diameter dimension of internal cylinder 50, however, as would be known to one skilled in the art, alternative inside diameter dimensions are suitable depending on the application. The minimum outside diameter dimension of outside cylinder 59 is six times the radial dimension of structural member 10. However, as one skilled in the art would know, alternative outside dimensions are suitable depending on the application.

As one skilled in the art would be aware of, internal cylinder 50 and outside cylinder 59 may be made of various suitable materials depending on the application. For example, suitable materials include metal, molded fiberglass, resin composites, cast bronze or brass and combinations thereof.

In alternative embodiments of clamp 60, additional features may be added. For example, dead man release switch 56 located on handle 81 quickly unlocks outside cylinder 59. Additionally, a ring wire clip 57 for attaching equipment may be added.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims.

What is claimed is:

1. A structural member comprising:

a triangular shaped member having an internal region and a first, a second, and a third internal vertex, wherein a rectangular sheet having a longitudinal axis, is folded around the longitudinal axis forming a first, a second, a third and a fourth sheet, wherein the first and the second sheets are a first and a second planar side that form two sides of the triangular shape, and wherein the third and the fourth sheets comprise a first and a second curved component, each having a concave inner surface and a convex outer surface, wherein the first and the second curved components are folded into the internal region of the triangular shape so that the outer surface of the first curved component joins to the outer surface of the second curved component thereby forming the third side of the triangular shape, and wherein each planar side, having an outer surface on the outside of the member and an inner surface on the inside of the member, and having a longitudinal axis in the same direction as the longitudinal axis of the triangular shape, further comprises a plurality of indentations spaced along the longitudinal axis of each planar side.

2. The structural member of claim 1, wherein each of the plurality of the indentations is semi-ellipsoidal in shape having a long axis and a short axis, and wherein each semi-ellipsoidal indentation is defined by rotation of a 36 degree, 16 minute ellipse around its long axis.

3. The structural member of claim 1, wherein each indentation further comprises a convex bulge on the inner surface of each planar side, and wherein the convex bulge of each indentation on the first planar side contacts the inner surface of the first curved component, and the convex bulge of each indentation on the second planar side contacts the inner surface of the second curved component.

4. The structural member of claim 1, further comprising three internal cavities within the internal region of the triangular shape, wherein each cavity has an apex at each internal vertex of the triangular shape, and wherein each cavity extends longitudinally for the entire length of the structural member.

5. The structural member of claim 4, further comprising a restraining element located at the point where the outer surface of the first curved component joins the outer surface of the second curved component.

6. The structural member of claim 5, wherein the restraining element further comprises a concave channel in the outer surface of the first curved component and a concave channel in the outer surface of the second curved component located directly opposite each other.

7. The structural member of claim 6, wherein each indentation, having an outside tangent point on the convex bulge, further comprises an embossed projection located at the outside tangent point.

8. The structural member of claim 7, wherein the projection of each indentation on the first planar side contacts the inner surface of the first curved component, and the projection of each indentations on the second planar side contacts the inner surface of the second curved component.

9. The structural member of claim 8, further comprising a first, a second, a third and a fourth stabilizing rod, wherein the first, the second and the third stabilizing rods are located at the apex of each internal cavity, and wherein the fourth stabilizing rod is located within the restraining element, and wherein each of the stabilizing rods extends longitudinally for the entire length of the structural member.

10. The structural member of claim 9, further comprising a first, a second and a third insert, wherein each one is located adjacent to the first, the second and the third stabilizing rod, respectively, within each internal cavity, and wherein each of the inserts extends longitudinally for the entire length of the structural member.

11. The structural member of claim 6, further comprising a first, a second, a third and a fourth stabilizing rod, wherein the first, the second and the third stabilizing rods are located, one each, at the apex of each internal cavity, and wherein the fourth stabilizing rod is located within the restraining element, and wherein each of the stabilizing rods extends longitudinally for the entire length of the structural member.

12. The structural member of claim 11, further comprising a first, a second and a third insert, wherein each one is located adjacent to the first, the second and the third stabilizing rod, respectively, within each internal cavity, and wherein each of the inserts extends longitudinally for the entire length of the structural member.

13. The structural member of claim 5, wherein the restraining element further comprises a concave recess in the outer surface of the first curved component and a convex bulge in the outer surface of the second curved component, wherein the concave recess and the convex bulge are mated together.

14. The structural member of claim 1, wherein the structural member further comprises a first and a second end, and wherein each first and second planar side further comprising a first and second sleeve located near each first and second end, respectively, and wherein each sleeve has a centerline aligned with the centerline of the indentations on each planar side.

15. An adapter for assembling two structural members according to claim 14, comprising:

a solid triangular shaped insert having a first and a second end and a longitudinal axis, and having a first and a second planar side forming two sides of the triangular shape, and a third shaped side forming the third side of the triangular shape, wherein the first and second planar sides have an outer surface and a centerline along the longitudinal axis, wherein the first and second planar sides further comprise a first and a second recess in the outer surface located at each first and second end, respectively, on the centerline of each planar side, and wherein each planar side further comprises a groove centered on the centerline.

16. An structural assembly comprising:

an adapter of claim 15 fit into a first and a second structural member, wherein the first recess on each planar side of the adapter is mated to a sleeve on a first end of each planar side of the first structural member and the second recess on each planar side of the adapter is mated to a sleeve on a first end of each planar side of the second structural member.

17. A method of assembling the structural assembly of claim 16 comprising:

obtaining the first and second structural members;

obtaining an adapter;

inserting the first end of the adapter into the internal region at the first end of the first structural member;

inserting each first sleeve on each planar side of the first member into the first recess on each planar side of the adapter, respectively;

inserting the second end of the adapter into the internal region at an end of the second structural member; and inserting the first sleeve on each planar side of the second member into the second recess on each planar side of the adapter, thereby joining the first structural member to the second structural member.

18. A joining clamp for joining the structural member of claim 1 to other structural members or to support braces comprising:

a right and a left hand bracket comprising a rectangular sheet having a long side and a short side, and tabs extending outward from the edge of the long side, wherein the rectangular sheet is folded into a vertical lower portion, having an inside surface and an outside surface, a horizontal middle portion and a slanted upper portion, and wherein the right hand bracket is aligned with the left hand bracket so that the inside surface of the right hand vertical lower portion is adjacent to the inside surface of the left hand vertical lower portion and the right hand horizontal middle portion and the left hand horizontal middle portion extend outwardly in opposite directions from the vertical lower portions, and wherein the right hand horizontal middle portion and right hand upper slanted portion and the left hand horizontal middle portion and left hand upper slanted portion together form a triangular shape, and wherein the right hand tabs and the left hand tabs are aligned alternately in a straight line parallel to the long side of each bracket, and wherein the tabs are bent together to create an open cylinder shape, and further comprising a locking pin located inside the cylinder shape extending the length of the joining clamp, and wherein the slanted upper portions further comprise a plurality of indentations, and wherein the vertical lower portions further comprise a plurality of hemispherical protrusion extending outwardly from each outside surface of the vertical lower portions, and wherein the clamp further comprises a hole having a centerline, wherein the centerline of the hole extends perpendicular to the outside surface of the vertical lower portions and through the protrusion on the right and left hand brackets, and wherein the clamp further comprises an extended rod, having a longitudinal centerline on the centerline of the hole extending through the hole.

19. A structural assembly comprising: the clamp of claim 18 assembled around one or more structural members, wherein the structural member is held within the triangular shape created by the horizontal middle portions and the slanted upper portions, and wherein each indentation of the clamp is mated to an indentation of the structural member, and further comprising a support brace mounted on the extended rod adjacent to the protrusion, and further comprising a locking pin having a centerline perpendicular to the extended rod and located adjacent to the support brace.

20. A method of assembling structural assemblies of claim 19 comprising:

obtaining one or more structural members;

assembling the clamp around each structural member, wherein each indentation of the clamp is mated to an indentation of the structural member;

mounting a support brace onto the extended rod of the clamp so that the support brace mates to the protrusion of the clamp; and inserting a locking pin through the extended rod of the clamp to hold the brace against the clamp.

21. A cylinder clamp assembly used with the structural member of claim 1 comprising: an external cylinder, having an inside surface and an outside surface, and an internal cylinder having an inside surface and an outside surface, and also having a plurality of rectangular slots, wherein each rectangular slot aligns with an indentation of the structural member, and further comprising retainers having an inner surface and an outer surface, wherein the inner surface of each retainer mates to an indentation of structural member, and wherein the outer surface of each retainer mates to the inside surface of the external cylinder.

22. A structural assembly comprising: the clamp assembly of claim 21 holding one or more structural members, wherein each retainer of the clamp assembly is installed through a slot of the clamp assembly into an indentation of the one or more structural members.

23. A method of assembling a structural assembly of claim 22 comprising:

obtaining one or more structural members;

inserting the one or more structural members into the internal cylinder of the clamp assembly;

aligning each slot of the internal cylinder of the clamp assembly with an indentation of the one or more structural members;

inserting a retainer into each slot of the internal cylinder to fit into an indentation of the one or more structural members;

installing the external cylinder around the internal cylinder; and rotating the external cylinder to hold the retainers in the structural member, thereby holding the one or more structural members within the clamp assembly.

24. A clamp assembly used with the structural member of claim 1 comprising:

a solid internal cylinder having an external surface, a radius, and a longitudinal axis, and having a centrally located triangular shaped open core extending longitudinally through the internal cylinder for the entire length of the internal cylinder, wherein the core has three internal apexes, and further comprising at least three bearings internally mounted at right angles to each apex of the triangular core along the longitudinal length of the internal cylinder, and further comprising two or more cavities extending in the direction of the radius through the internal cylinder into the core, and wherein the clamp assembly further comprises a foot support attached to the external surface of the internal cylinder extending outward perpendicular to the longitudinal axis of the internal cylinder, and wherein the structural member fits inside the core of the internal cylinder, and wherein the clamp further comprises two or more retaining ball assemblies, wherein the retaining ball assemblies further comprise two or more retaining balls and a connecting cable, and wherein the clamp further comprises an outside cylinder having a longitudinal axis, and an internal surface and an external surface, wherein the internal surface further comprises two or more linear cam recesses, and wherein the outside cylinder is installed around the internal cylinder, and wherein each retaining ball of each retaining ball assembly is mounted inside each linear cam recess and passes through the cavity of the internal cylinder into the core and fits into an indentation of the structural member, and wherein the clamp further comprises a handle attached to the external surface of the outside cylinder that rotates the outside cylinder around its longitudinal axis thereby moving each linear cam recess so that the retaining ball of each retaining ball assembly moves from a position fitted into an indentation of the structural member to a position removed from the indentation of the structural member.

25. A clamping assembly used with the clamp assembly of claim 24 comprising:

one or more structural members installed within the clamp assembly, wherein each structural member slides within the core of the clamp assembly.

26. A method of using the clamping assembly of claim 25 comprising:

preparing the clamp assembly;

inserting one or more structural members into the core of each clamp assembly;

installing each of the one or more structural members in the configurations desired;

mounting the foot support of each clamp assembly; and alternately rotating the handle of each clamp assembly to move alternately along the structural members.

27. A structural member comprising:

a generally triangular shaped member having an internal region and a first, a second, and a third internal vertex, wherein a rectangular sheet having a longitudinal axis, is folded around the longitudinal axis forming a first, a second, a third and a fourth sheet, wherein the first and the second sheets are a first and a second planar side that form two sides of the triangular shape, and wherein the third and the fourth sheets comprise a first and a second curved component, each having a concave inner surface and a convex outer surface and a rounded edge, wherein the first and the second curved components are folded into the internal region of the triangular shape so that the rounded edge of the first curved component and the rounded edge of the second curved component are located within the internal region thereby forming the third side of the triangular shape, and wherein each planar side, having an outer surface on the outside of the member and an inner surface on the inside of the member, and having a longitudinal axis in the same direction as the longitudinal axis of the triangular shape, further comprises a plurality of indentations spaced along the longitudinal axis of each planar side.

28. The structural member of claim 27, wherein each of the plurality of the indentations is semi-ellipsoidal in shape having a long axis and a short axis, and wherein each semi-ellipsoidal indentation is defined by rotation of a 36 degree, 16 minute ellipse around its long axes.

29. The structural member of claim 28, further comprising three internal cavities within the internal region of the triangular shape, wherein each cavity has an apex corresponding to each internal vertex of the triangular shape, and wherein each cavity extends longitudinally through the entire structural member.

30. The structural member of claim 29, further comprising a first, a second and a third stabilizing rod, wherein each one of the first, the second and the third stabilizing rods are located at the apex of each internal cavity, and wherein each of the stabilizing rods extends longitudinally for the entire length of the structural member.

31. The structural member of claim 30, further comprising a first, a second and a third insert, wherein each one is located adjacent to the first, the second and the third stabilizing rod, respectively, within each cavity, and wherein each of the inserts extends longitudinally for the entire length of the member.

32. A structural assembly comprising:

a two-sided panel, wherein the first side has a first channel and the second side has a second channel located opposite the first channel, wherein each channel extends for the entire length of the side, wherein the panel is fit into a structural member of claim 27, wherein the rounded edge of the first curved component of the structural member fits into the first channel of the panel, and wherein the rounded edge of the second curved component of the structural member fits into the second channel of the panel, thereby locking the panel and the structural member together.

33. A method of preparing the structural assembly of claim 19, comprising:

installing the panel into the internal region of the structural member, wherein the panel meets the indentations of the structural member;

fitting the rounded edge of the first curved component into the first channel of the panel; and fitting the rounded edge of the second curved component into the second channel of the panel.

* * * * *